US007094295B2

(12) United States Patent
Oku et al.

(10) Patent No.: US 7,094,295 B2
(45) Date of Patent: Aug. 22, 2006

(54) FERRITIC STAINLESS STEEL SHEET HAVING GOOD WORKABILITY AND MANUFACTURING METHOD THEREOF

(75) Inventors: Manabu Oku, Shin-Nanyo (JP); Yoshitomo Fujimura, Shin-Nanyo (JP); Yoshiaki Hori, Shin-Nanyo (JP); Toshirou Nagoya, Shin-Nanyo (JP); Yasutoshi Kunitake, Shin-Nanyo (JP); Takeo Tomita, Shin-Nanyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 102 days.

(21) Appl. No.: 10/695,185

(22) Filed: Oct. 28, 2003

(65) Prior Publication Data

US 2004/0084116 A1 May 6, 2004

Related U.S. Application Data

(62) Division of application No. 10/027,850, filed on Dec. 21, 2001, now Pat. No. 6,673,166.

(30) Foreign Application Priority Data

Dec. 25, 2000 (JP) ..... 2000-392911
Dec. 25, 2000 (JP) ..... 2000-392912

(51) Int. Cl.
*C21D 6/02* (2006.01)

(52) U.S. Cl. ..... 148/592; 148/607

(58) Field of Classification Search ..... 148/624, 148/623, 622, 608, 607, 326
See application file for complete search history.

(56) References Cited

U.S. PATENT DOCUMENTS 4,726,853 A * 2/1988 Gressin et al. ..... 148/610
5,019,181 A * 5/1991 Yazawa et al. ..... 148/610

FOREIGN PATENT DOCUMENTS

| | | | |
|---|---|---|---|
| JP | 5129694 | | 8/1976 |
| JP | 5135369 | | 10/1976 |
| JP | 0617519 | | 3/1994 |
| JP | 408199235 | * | 8/1996 |
| JP | 08311542 | | 11/1996 |
| JP | 410017999 A | * | 1/1998 |
| JP | 2002194508 | * | 7/2002 |
| JP | 2002212681 | * | 7/2002 |

* cited by examiner

*Primary Examiner*—George Wyszomierski
(74) *Attorney, Agent, or Firm*—The Webb Law Firm

(57) ABSTRACT

A method of manufacturing a ferritic stainless steel sheet having good workability with less anisotropy. The steps include providing a ferritic stainless steel comprising C up to about 0.03 mass %, N up to about 0.03 mass %, Si up to about 2.0 mass %, Mn up to about 2.0 mass %, Ni up to about 0.6 mass %, Cr about 9–35 mass %, Nb about 0.15–0.80 mass % and the balance being Fe except inevitable impurities; precipitation-heating said stainless steel at a temperature in a range of 700–850° C. for a time period not longer than 25 hours; and finish-annealing said stainless steel at a temperature in a range of 900–1100° C. for a time period not longer than 1 minute.

3 Claims, 2 Drawing Sheets

FERRITIC STAINLESS STEEL SHEET HAVING GOOD WORKABILITY AND MANUFACTURING METHOD THEREOF

CROSS-REFERENCE TO RELATED APPLICATIONS

This application is a divisional of U.S. application Ser. No. 10/027,850 filed Dec. 21, 2001 now U.S. Pat. No. 6,673,166.

BACKGROUND OF THE INVENTION

1. Field of the Invention

The present invention relates to a ferritic stainless steel having good workability with less anisotropy useful as material worked to sheets for an automobile and other parts.

2. Description of Related Art

Ferritic stainless steels having improved heat- and corrosion-resistance by stabilization of C and N with Nb or Ti have been used in broad industrial fields. For instance, such ferritic stainless steel is used as a member of an exhaust system for an automobile. A steel material such as SUS409L, SUS436L or SUS436J1L, which contains Nb or Ti to suppress sensitization and to improve intergranular corrosion-resistance, is used as a center pipe or muffler having good corrosion-resistance. A steel material such as SUS430LX, SUS430J1L or SUS444, which contains Nb or Ti more than a stoichiometric ratio of C and N contents to improve high-temperature strength due to dissolution of surplus Nb or Ti in a steel matrix is used as an exhaust manifold or front pipe having good heat-resistance.

In addition, there is the tendency that a member of an exhaust system is designed in a more and more complicated shape for space-saving and for improvement in exhaust efficiency. Due to such complicated shapes, ferritic stainless steel should possess superior workability without occurrence of defects even after severe deformation.

Demand for improvement of workability is not only for use as an exhaust system but also for other uses. That is, ferritic stainless steel shall be deformed with heavier duty as more complicated shape of a product in order to improve function and/or design of the product.

There are various proposals for improvement of ferritic stainless steel in workability. These proposals are basically classified to proper control of composition and proper control of manufacturing conditions.

An alloying design proposed by JP 51-29694B and JP 51-35369B is to reduce C and N contents together with addition of carbonitride-forming elements such as Ti or Nb at a relatively great ratio. Addition of Ti and/or Nb to ferritic stainless steel for use as a member for an exhaust system is meaningful in improvement of workability and performance for system requirements, since the additives Ti and Nb improve the workability of the steel as well as corrosion- and heat-resistance necessary for a member for an exhaust system.

A value $\bar{r}$ representing deep drawability is surely improved by the addition of Ti and/or Nb, but the additives Ti and Nb unfavorably enlarge in-plane anisotropy $\Delta r$ of the value $\bar{r}$. In this sense, mere addition of such alloying elements is not enough to bestow ferritic stainless steel with sufficient workability, which meets requirements for severe deformation.

Addition of one or more of Al, B and Cu is also known for improvement of workability.

There have also been proposed various methods on proper control of manufacturing conditions from a steel-making step to a cold-rolling or finish-annealing step. For instance, reformation of an as-cast slab to tesseral crystalline structure in a steel-making step, and lowering of an initial temperature, soaking a steel strip at a proper temperature, lowering of a finish temperature and lowering of a coiling temperature in a hot-rolling step. These temperature controls are often carried out in combination with control of a reduction ratio. Control of a friction coefficient between a steel strip and a work roll during hot-rolling is also effective for improvement of workability. All of these methods aim at destruction of an as-cast structure, which puts harmful influences on re-crystallization.

Even in steps succeeding to the hot-rolling step, increase of a cold-rolling ratio is also effective for improvement of a value $\bar{r}$ with less in-plane anisotropy $\Delta r$, as reported in "Stainless Steel Handbook" (edited by Stainless Steel Society in Japan and issued by Nikkan Kogyo Shimbun Co. in 1995) p.935. A cold-rolling ratio of Ti-alloyed steel is necessarily determined at a value more than 60% (preferably 70–90%) for the purpose. Twice cold rolling-twice annealing in various combinations of cold rolling conditions with annealing conditions or with a bigger work roll is also effective for improvement of workability. For instance, a steel material based on SUS430 composition, to which alloying elements are alloyed at small ratios, or a steel material based on SUS430 compositions, to which Al and Ti are alloyed, are those steels improved in workability by manufacturing conditions.

However, there are only a few reports on investigation of manufacturing conditions of Ti- or Nb-alloyed ferritic stainless steel for corrosion- or heat-resistance use, with extension referring to knowledge represented by "one or two of Ti and Nb", as described in JP 6-17519B and JP 8-311542A. These methods proposed so far need additional means in a conventional manufacturing process or inevitably change a manufacturing process itself, resulting in rising of a manufacturing cost and a product cost in the end.

Effects of manufacturing conditions on workability have been researched for a ferritic stainless steel sheet of 0.7–0.8 mm in thickness, but such effects on workability of a ferritic stainless steel sheet thicker than 1.0 mm are not clarified yet. Taking into account actual use, a thicker steel sheet of 2 mm or so in thickness has been broadly used as a member of an exhaust system for an automobile. When the above-mentioned method is applied to a process of manufacturing such a thick stainless steel sheet, a hot-rolled steel strip is necessarily thicker than 6 mm in order to realize a cold-rolling ratio of more than 70%. As a result, a hot-rolled steel sheet shall be cold-rolled with a heavy duty while stabilizing its traveling influenced by low-temperature toughness and bendability, so that rising of a manufacturing cost is unavoidable.

In short, there is a strong need for a Ti- or Nb-alloyed ferritic stainless steel having good workability without the necessity of additional means or rising of manufacturing cost, even when the ferritic stainless steel is rolled to a strip thicker than 1.0 mm.

SUMMARY OF THE INVENTION

The present invention aims at provision of a ferritic stainless steel sheet improved in workability by an effect of Nb-containing precipitates on control of crystalline orientation, without reduction of elements harmful on corrosion- or heat-resistance or addition of special elements effective for corrosion- or heat-resistance, and further, without restrictions on thickness. The presence of fine Nb-containing precipitates in a steel matrix is also effective for improvement of workability with less in-plane anisotropy.

The present invention newly proposes two types of ferritic stainless steel sheets having good workability.

A first proposal is directed to a ferritic stainless steel sheet, comprising C up to about 0.03 mass %, N up to about 0.03 mass %, Si up to about 2.0 mass %, Mn up to about 2.0 mass %, Ni up to about 0.6 mass %, about 9–35 mass % Cr, about 0.15–0.80 mass % Nb and the balance being Fe except inevitable impurities, comprising a metallurgical structure involving precipitates of about 2 μm or less in particle size at a ratio not more than about 0.5 mass % and has crystalline orientation on a surface at ¼ depth of thickness with Integrated Density defined by the formula (a) not less than 1.2.

$$\text{Integrated Intensity}=[I_{(211)}/I_{0(211)}]/[I_{(200)}/I_{0(200)}] \quad \text{(a)}$$

wherein, $I_{(211)}$ and $I_{(200)}$ represents diffraction intensities on (211) and (200) planes of a sample of said steel measured by XRD, while $I_{0(211)}$ and $I_{0(200)}$ represents diffraction intensities on (211) and (200) planes of a non-directional sample.

The ferritic stainless steel sheet may further contain one or more of Ti up to about 0.5 mass %, Mo up to about 3.0 mass %, Cu up to about 2.0 mass % and Al up to about 6.0 mass %. The ferritic stainless steel is offered as a hot-rolled steel strip, a hot-rolled steel sheet, a cold-rolled steel strip, a cold-rolled steel sheet or a welded steep pipe on the market. The wording "steel sheet" involves all of these materials in this specification.

The ferritic stainless steel sheet is manufactured by a process involving a step of precipitation-treatment at about 700–850° C. for about 25 hours or shorter in prior to 1 minute or shorter finish-annealing at about 900–1100° C.

A second proposal is directed to a ferritic stainless steel sheet having good workability with less in-plane anisotropy. This stainless steel sheet has the same composition as mentioned above, comprises metallurgical structure involving fine precipitates of about 0.5 ∞m or less in particle size controlled at a ratio not more than about 0.5 mass % in a finish-annealed state by dissolving fine precipitates, which have been once generated by heating, in a steel matrix during finish-annealing, and has crystal orientation with Integrated Intensity defined by the formula (b) not less than 2.0.

$$\text{Integrated Intensity}=[I_{(222)}/I_{0(222)}]/[I_{(200)}/I_{0(200)}] \quad \text{(b)}$$

wherein, $I_{(222)}$ and $I_{(200)}$ represents diffraction intensities on (222) and (200) planes of a sample of said steel sheet measured by XRD, while $I_{0(222)}$ and $I_{0(200)}$ represents diffraction intensities on (222) and (200) planes of a non-directional sample.

Integrated Intensity defined by the formula (b) is kept at a level not less than 2.0 by controlling Nb-containing fine precipitates, which has been once generated by heat-treatment prior to finish-annealing, at a ratio in a range of 0.4–1.2 mass %.

Such ferritic stainless steel is manufactured by precipitation-heating the steel having the specified composition at a temperature in a range of 450–750° C. for 20 hrs. or shorter at any one of steps prior to finish-annealing, and then heating at 900–1100° C. for 1 minute or shorter during finish-annealing.

DETAILED DESCRIPTION OF THE INVENTION

The inventors have researched effects of compositions and manufacturing conditions on workability from various aspects, on the presumption that ferritic stainless steels containing one or both of Nb and Ti at ratios enough to stabilize C and N as carbonitrides are cold-rolled at a reduction ratio of 50–60%, which is generally regarded as a value insufficient for increase of a value $\bar{r}$. In the course of research, the inventors have discovered that Nb-alloyed ferritic stainless steel can be processed to a steel strip or sheet having good workability by heat-treatment to generate precipitates on any stage prior to finish-annealing.

The present invention, which is based on the newly discovered effect of precipitates, enables production of a stainless steel sheet having good workability even when its thickness exceeds 1.0 mm.

Figure 1:
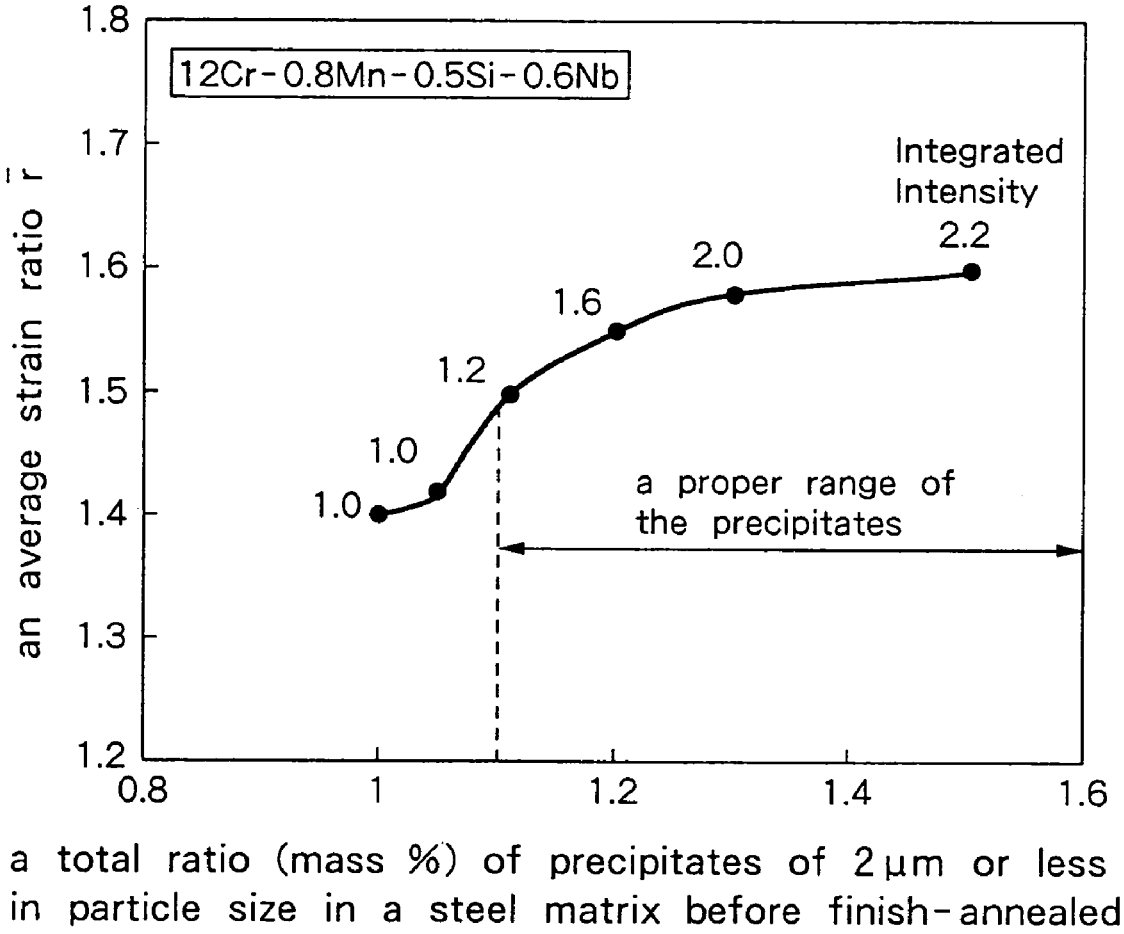
FIG. 1 is a graph showing an effect of precipitates distributed in a steel matrix before finish-annealing on average strain ratio of a finish-annealed steel sheet.

Precipitates, which are generated by precipitation-treatment prior to finish-annealing, exhibit quantitative effects on workability of a ferritic stainless steel sheet. For instance, FIG. 1 shows a relationship between a total ratio of precipitates of 2 μm or less in particle size and workability of a ferritic stainless steel sheet, which was manufactured by 30 seconds precipitation-treatment of a 12Cr-0.8Mn-0.5Si-0.6Nb steel sheet of 4.5 mm in thickness to generate precipitates, cold-rolling to thickness of 2.0 mm and then finish-annealing at 1040° C. Abrupt increase of an average plastic strain ratio $\bar{r}$ is noted as increase of a total ratio of precipitates of 2 μm or less in particle size above 1.1 mass %. Integrated Intensity defined by the above-mentioned formula (a) also increases to a level of 1.2 or more, where the ferritic stainless steel sheet is deformed to an objective shape with good workability, in response to increase of the average plastic strain ratio $\bar{r}$.

Taking into account the above-mentioned results, it is understood that Integrated Intensity defined by the formula (a) shall be kept at a value not less than 1.2 in order to provide a ferritic stainless steel having good workability, in other words, an average value $\bar{r}$ of 1.5 or more. Integrated Intensity of 1.2 or more is realized by generating precipitates of 2 μm or less in particle size at a total ratio of 1.1 mass % or more. A total ratio of precipitates is preferably kept at a relatively low level in the specified range since the precipitates act as starting points of brittle fracture, although a total ratio of precipitates in a finish-annealed state is not necessarily controlled for a stainless steel sheet for use as a member whose toughness is not much valued.

Good workability with less in-plane anisotropy is realized by controlling a ratio of fine precipitates of 0.5 μm or less at a total ratio not more than 0.5 mass % in a finish-annealed steel sheet.

For instance, 14Cr-1Mn-1Si-0.4Nb-0.1Cu steel was processed to a hot-rolled steel sheet of 4.5 mm in thickness, heated 30 seconds to generate fine precipitates, cold-rolled to a thickness of 2.0 mm, and then finish-annealed at 1040° C. Under such the conditions, a temperature for precipitation-treatment was varied in order to investigate an effect of precipitation-treatment on generation of fine precipitates.

Workability of the finish-annealed steel sheet was examined and classified in relation with a total ratio of fine precipitates of 0.5 μm or less in particle size, which were present in a steel matrix before the finish-annealing. The workability is evaluated as an average value $\bar{r}$ and in-plane anisotropy $\Delta r$. Results are shown in FIG. 2, wherein Integrated Intensity defined by the formula (b) is also pointed.

Figure 2:
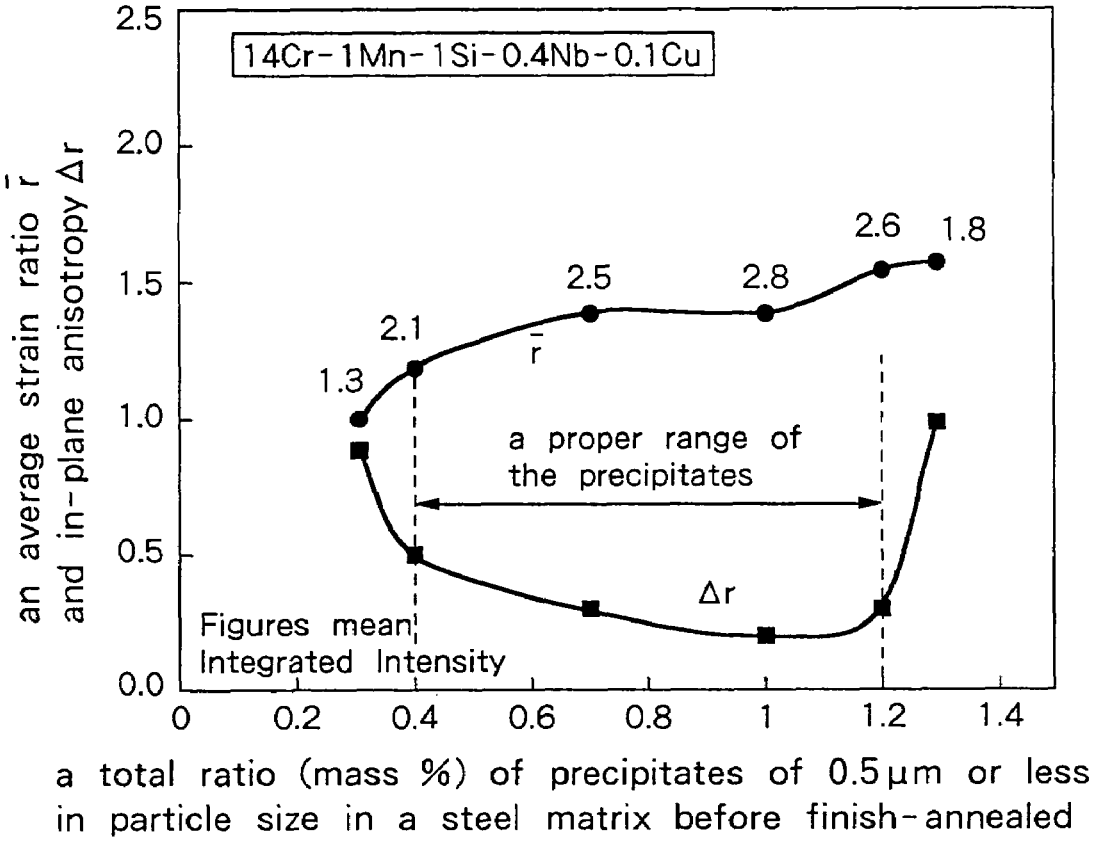
FIG. 2 is another graph showing an effect of fine precipitates distributed in a steel matrix before finish-annealing on average strain ratio and in-plane anisotropy of a finish-annealed steel sheet.

Results shown in FIG. 2 prove that increase of fine precipitates of 0.5 μm or less in particle size at a total ratio more than 0.4 mass % causes increase of an average value $\bar{r}$ and decrease of in-plane anisotropy $\Delta r$. Increase of fine precipitates also results in increase of Integrated Intensity. Integrated Intensity is kept at a level not less than 2.0, in a region where the ferritic stainless steel exhibits good workability. On the other hand, a total ratio of fine precipitates above 1.2 mass % causes abrupt increase of in-plane anisotropy and decrease of Integrated Intensity, although an average value $\bar{r}$ is not reduced regardless the ratio of fine precipitates.

Taking into account the above-mentioned results, it is understood that Integrated Intensity defined by the formula (b) shall be kept at a value not less than 2.0 in order to provide a ferritic stainless steel having good workability, in other words, an average value $\bar{r}$ of 1.2 or more with in-plane anisotropy $\Delta r$ of 0.5 or less. Integrated Intensity of 2.0 or more is realized by generating fine precipitates of 0.5 μm or less in particle size at a total ratio in a range of 0.4–1.2 mass %. In the alloy system of the present invention, a total ratio of fine precipitates is preferably kept at a relatively low level in a range of about 0.4–1.2 mass % since the precipitates act as starting points of brittle fracture, although a total ratio of fine precipitates in a finish-annealed state is not necessarily controlled for a stainless steel sheet for use as a member whose toughness is not much valued. Toughness of the ferritic stainless steel sheet is ensured by dissolution of fine precipitates, which were used for controlling growth of aggregate structure, in a finish-annealing step, so as to reduce a total ratio of fine precipitates of 0.5 μm or less in particle size to 0.5 mass % or less after the finish-annealing.

Change of workability in response to a total ratio of precipitates is not sufficiently clarified yet, but the inventors suppose the effect of precipitates on workability as follows: A hot-rolled steel strip or sheet is reformed to a metallurgical structure, wherein a lot of Nb-containing precipitates are distributed, by annealing it at a temperature lower than its re-crystallizing temperature. In the invented alloy system, the Nb-containing precipitates are Laves phase based on $Fe_3Nb$ and carbonitrides based on $Fe_3Nb_3C$. Such precipitates promote preferential growth of (211) and (222) plane aggregate structure effective for improvement of workability but impede growth of (200) plane aggregate structure harmful on workability, during finish-annealing. Consequently, an annealed steel sheet has good workability.

Toughness of the ferritic stainless steel sheet is ensured by dissolution of precipitates, which were used for controlling growth of aggregate structure, in a finish-annealing step, so as to reduce a total ratio of precipitates of 2 μm or less, preferably 0.5 μm or less in particle size to 0.5 mass % or less after the finish-annealing.

The newly proposed ferritic stainless steel has the composition specified as follows:

Each of C and N up to 0.03 Mass %

Although C and N are elements for improvement of high-temperature strength such as creep strength in general, excessive addition of C and N not only worsens corrosion-resistance, oxidation-resistance, workability and toughness but also necessitates increase of Nb content to stabilize C and N as carbonitrides. In this sense, C and N contents are preferably adjusted at low levels. In practical use, each of C and N contents are controlled not more than about 0.03 mass % (preferably 0.02 mass %).

Si up to 2.0 Mass %

Si is an alloying element very effective for improvement of oxidation-resistance at a high temperature. But excessive addition of Si causes an increase of hardness and worsens workability and toughness. In this sense, the Si content is adjusted at a level not more than about 2.0 mass % (preferably 1.5 mass %).

Mn up to 2.0 Mass %

Mn is an alloying element for improvement of oxidation-resistance at a high temperature as well as separability of scale, but excessive addition of Mn puts harmful influences on weldability. Furthermore, excessive addition of Mn, which is an austenite former, promotes generation of martensite phase, resulting in degradation of workability. Therefore, an upper limit of Mn content is determined at about 2.0 mass % (preferably 1.5 mass Ni up to 0.6 Mass %

Ni is an element which stabilizes austenite phase, so that excessive addition of Ni promotes generation of martensite phase and worsens workability, the same as Mn. Ni is an expensive element, too. In this sense, an upper limit of Ni content is determined at about 0.6 mass % (preferably 0.5 mass %).

9–35 Mass % Cr

Cr is an essential element for stabilization of ferrite phase, oxidation-resistance necessary for high-temperature use, and pitting- and weather-resistance necessary for use in a corrosive environment. Heat- and corrosion-resistance is better as the Cr content increases, but excessive addition of Cr causes embrittlement of steel and increase of hardness, resulting in degradation of workability. Therefore, Cr content is controlled in a range of about 9–35 mass % (preferably 12–19 mass %). 0.15–0.80 mass % Nb In general, Nb stabilizes C and N as carbonitrides, and the remaining Nb improves high-temperature strength of steel. Furthermore, the additive Nb is used for controlling re-crystallized aggregate structure in the invented steel. Generation of fine precipitates is ensured by dissolution of Nb in a matrix of a hot-rolled steel sheet.

A part of the additive Nb consumed for stabilization of C and N as carbonitrides exists in the form of Nb(C, N), and does not substantially change its form or its ratio from a hot-rolling step to a finish-annealing step. On the other hand, the other part of the additive Nb dissolved in a hot-rolled steel strip or sheet precipitates as $Fe_3Nb_3C$, $Fe_2Nb$ or the like by precipitation-treatment prior to finish-annealing, and the precipitates favorably control preferential growth of re-crystallized aggregate structure effective for improvement of workability. In this sense, a ratio of Nb shall be kept at a level more than a ratio necessary for stabilization of C and N as carbonitrides. Therefore, a lower limit of Nb content is determined at about 0.15 mass % (preferably 0.20 mass %). However, a ratio of Nb is controlled not more than 0.80 mass % (preferably 0.50 mass %), since excessive addition of Nb causes too-much generation of precipitates harmful on toughness.

Ti up to 0.5 Mass %

Ti is an optional element, which stabilizes C and N as carbonitrides, the same as Nb, and improves intergranular corrosion-resistance. But, excessive addition of Ti worsens toughness and workability of steel and puts harmful influences on external appearance of a steel sheet. In this sense, an upper limit of Ti content is determined at about 0.5 mass % (preferably 0.3 mass %).

Mo up to 3.0 Mass %

Mo is an element for improvement of corrosion-resistance and heat-resistance (including high-temperature strength and oxidation-resistance at a high temperature), so Mo is optionally added to steel for use which needs excellent properties. However, excessive addition of Mo worsens hot-rollability, workability and toughness of steel and also raises steel cost. In this sense, an upper limit of Mo content is determined at about 3.0 mass % (preferably 2.5 mass %).

Cu up to 2.0 Mass %

Cu is an optional alloying element for improvement of corrosion-resistance and high-temperature strength and also bestows the ferritic stainless steel with anti-microbial property. However, excessive addition of Cu causes degradation of hot-rollability of the steel and worsens workability and toughness. In this sense, an upper limit of Cu content is determined at about 2.0 mass % (preferably 1.5 mass %).

Al up to 6.0 Mass %

Al is an optional alloying element for improvement of oxidation-resistance of the ferritic stainless steel at a high temperature, the same as Si. But excessive addition of Al causes increase of hardness and worsens workability and toughness of the steel. In this sense, an upper limit of Al content is determined about 6.0 mass % (preferably 4.0 mass %).

Ratios of the other elements are not especially defined in the present invention, but one or more of such other elements may be added as desired. For instance, Ta, W, V and Co for high-temperature strength, Y and REM for oxidation-resistance at a high temperature and Ca, Mg and B for hot-workability and toughness. A ratio of Ta, W, V and/or Co is preferably up to about 3.0 mass %, a ratio of Y and/or REM is preferably up to 0.5 mass %, and a ratio of Ca, Mg and/or B is preferably up to 0.05 mass %.

Ordinary impurities such as P, S and O are preferably controlled at the lowest possible level. For instance, P not more than 0.04 mass %, S not more than 0.03 mass %, and O not more than 0.02 mass %. These impurities may be severely controlled to further low levels in order to improve workability and toughness of the steel.

Manufacturing Conditions of The First-Type Stainless Steel Sheet

A ferritic stainless steel sheet is heated at about 700–850° C. for a time period of 25 hours or shorter to precipitate Nb-containing particles in a steel matrix. Precipitation-treatment is performed on any stage from a steel-making step before a finish-annealing step, using a continuous or a batch-type annealing oven. Conditions of precipitation-treatment are controlled so as to generate a proper ratio of precipitates of 2 μm or less in particle size effective for workability.

Workability of a stainless steel sheet is remarkably improved by generation of precipitates of 2 μm or less at a total ratio not less than 1.1 mass %. Precipitates of 2 μm or less in particle size are generated at a heating temperature of 700° C. or higher, but over-heating at a temperature above 850° C. causes growth of precipitates more than 2 μm in particle size. On the other hand, generation of precipitates of 2 μm or less in particle size is insufficient by heating at a lower temperature below 700° C.

A time period t for precipitation-treatment is properly determined in response to a heating temperature T (° C.). In practical, the time period t and the heating temperature T are determined so as to maintain a value λ defined by the following formula in a range of about 19–23. The precipitation-treatment shall be completed in 25 hours; otherwise, precipitates would grow up to coarse particles with less productivity due to long-term heating.

$$\lambda=(T+273)\times(20+\log t)/1000$$

A stainless steel sheet of metallurgical structure, wherein precipitates of 2 μm or less in particle size have been distributed at a proper ratio by the precipitation-treatment, is finish-annealed at 900–1100° C. for re-crystallization to diminish a rolling texture. Re-crystallization occurs at an annealing temperature of 900° C. or higher, but over-annealing at a temperature above 1100° C. accelerates generation of coarse crystal grains and worsens toughness of a steel sheet. The finish-annealing is preferably completed in 1 minute, taking into account productivity and energy consumption.

Conditions of finish-annealing are controlled so as to reduce a total ratio of undissolved precipitates of 2 μm or less in particle size below 0.5 mass % for improvement of toughness (especially secondary workability). If too many precipitates remain in a finish-annealed state of a steel product, they act as the starting point of brittle fracture.

Re-crystallization, which occurs during finish-annealing, is affected by Nb-containing precipitates. That is, (211) plane aggregate structure is preferentially grown up, while growth of (100) plane aggregate structure is suppressed. Consequently, Integrated Intensity defined by the above-mentioned formula (a) increases to a level of 1.2 or more. Due to increase of Integrated Intensity, the finish-annealed stainless steel sheet is improved in workability with an average plastic strain ratio $\bar{r}$ of 1.5 or more.

Manufacturing Conditions of The Second-Type Stainless Steel Sheet

A ferritic stainless steel sheet is heated at 450–750° C. in any stage prior to finish-annealing, in order to precipitate fine Nb-containing particles in a steel matrix. Conditions of precipitation-treatment are controlled so as to distribute fine precipitates of 0.5 μm or less in particle size in a steel matrix at a total ratio of not less than 0.4 mass %. If the steel is heated at a temperature below 450° C., generation of fine precipitates is scarcely noted. If the steel is heated at a temperature above 750° C., on the contrary, precipitates grow up to coarse particles more than 0.5 μm in size.

The ferritic stainless steel is heated at the specified temperature for a time shorter than 20 hrs. in order to suppress growth of precipitates to coarse particles. Although combination of a temperature with a heating time for precipitation-treatment is not especially defined in the present invention, the heating conditions are preferably determined so as to keep the above-mentioned value λ in a range of 13–19 in order to stabilize properties of the ferritic stainless steel.

The ferritic stainless steel is then finish-annealed at a temperature in a range of 900–1100° C. for a time period of 1 minute or shorter. If a temperature for finish-annealing is below a re-crystallization temperature, the annealed steel comprises a structure wherein rolling texture remains without sufficient dissolution of fine precipitates generated by the precipitation-treatment. The remaining rolling texture unfavorably impedes reduction of in-plane anisotropy, while the remaining precipitates degrade toughness and secondary workability of a steel product. But over-heating above 110° C. causes coarsening of crystal grains, resulting in insufficient toughness.

Integrated Intensity defined by the above-mentioned formula (b) is to be controlled to a level of 2.0 or more, so as to assure preferential growth of (222) plane aggregate structure for good workability with less anisotropy.

As far as a hot-rolled steel strip is subjected to the precipitation-treatment prior to finish-annealing for re-crystallization, the other manufacturing conditions are not necessarily defined. For instance, a steel strip may be cold-rolled once or more times, but shall not be heated up to a re-crystallization temperature in the steps other than the finish-annealing. Especially in case of two or more times cold-rolling, stress-relief annealing after a cold-rolling step shall be performed below the re-crystallization temperature so as to inhibit generation of re-crystallized structure. Hot-rolling conditions are not necessarily specified, since re-crystallization is avoided during hot-rolling at an ordinary temperature in a range of 800–1250° C.

In the case where a hot-rolled steel strip is immediately cooled with water and then coiled, fine precipitates are not generated in a steel matrix. In this case, precipitation-treatment for generation of fine precipitates is performed after the hot-rolling step. Of course, fine precipitates may be generated by controlling a cooling speed of a steel strip just after the hot-rolling. In this case, heat-treatment for generation of fine precipitates is not necessarily required in the succeeding steps.

In order to generate precipitates of 2 μm or less in particle size at a proper ratio on a cooling stage after hot-rolling, a hot-rolled steel strip is air-cooled and optionally water-cooled under the conditions that the aforementioned conditions of precipitation-treatment are satisfied during cooling of the hot-rolled steel strip.

The present invention is typically advantageous for a stainless steel sheet of 1.0 mm or more in thickness, although there are no special restrictions on a shape of a steel product. Of course, features of the present invention are realized even in a case of a stainless steel sheet thinner than 1.0 mm or a product made from the stainless steel sheet by working or welding it to a certain shape.

EXAMPLE 1

Several kinds of steels having compositions shown in Table 1 were melted in a 30 kg-vacuum furnace, cast to a slab of 40 mm in thickness, soaked 2 hrs. at 1250° C., hot-rolled to thickness of 4.5 mm and then cooled with water. In Table 1, No. 8 corresponds to SUS409, and No. 9 corresponds to SUS436.

TABLE 1

CHEMICAL COMPOSITIONS OF STAINLESS STEELS

| Steel | Alloying elements (mass) | | | | | | | | |
|---|---|---|---|---|---|---|---|---|---|
| No. | C | Si | Mn | Ni | Cr | Nb | N | Others | Note |
| 1 | 0.007 | 0.85 | 0.81 | 0.07 | 8.63 | 0.35 | 0.006 | Cu: 0.06 | Inventive |
| 2 | 0.025 | 0.51 | 0.75 | 0.11 | 12.02 | 0.58 | 0.010 | — | Examples |
| 3 | 0.012 | 0.93 | 1.08 | 0.11 | 14.47 | 0.40 | 0.011 | Cu: 0.10 | |
| 4 | 0.014 | 0.31 | 0.34 | 0.12 | 17.85 | 0.42 | 0.010 | Mo: 0.52 | |
| 5 | 0.011 | 0.52 | 0.43 | 0.13 | 19.52 | 0.41 | 0.015 | Cu: 0.49 | |
| 6 | 0.009 | 0.26 | 0.99 | 0.13 | 18.57 | 0.79 | 0.007 | Cu: 0.24, Mo: 2.94 | |
| 7 | 0.010 | 0.22 | 0.98 | 0.11 | 18.43 | 0.97 | 0.011 | Cu: 0.23, Mo: 2.24 | Comparative |
| 8 | 0.014 | 0.37 | 0.31 | 0.12 | 17.92 | — | 0.012 | Ti: 0.18, Mo: 1.03 | Examples |
| 9 | 0.007 | 0.53 | 0.44 | 0.08 | 11.15 | — | 0.005 | Ti: 0.21 | |

The underlined figures are out of the range of the present invention

Each hot-rolled steel strip was cold-rolled to thickness of 2.0 mm and then finish-annealed under conditions shown in Table 2.

TABLE 2

MANUFACTURING CONDITIONS

| Example | Steel | Heating of hot-rolled steel strips | | cold-rolling | Heating of cold-rolled steel strips | | Finish-annealing | | |
|---|---|---|---|---|---|---|---|---|---|
| No. | No. | temp. (° C.) | seconds | (mm) | temp. (° C.) | seconds | temp. (° C.) | seconds | Note |
| 1 | 1 | 700 | 3600 | 4.5/2.0 | — | — | 900 | 10 | Inventive |
| 2 | 2 | 700 | 3600 | 4.5/2.0 | — | — | 1060 | 10 | Examples |
| 3 | 3 | 700 | 3600 | 4.5/2.0 | — | — | 1040 | 10 | |
| 4 | 2 | 800 | 3600 | 3.5/1.5 | — | — | 1040 | 10 | |
| 5 | 2 | — | — | 4.5/2.0 | 850 | 10 | 1040 | 10 | |
| 6 | 2 | — | — | 4.5/2.0 | 700 | 36000 | 1040 | 10 | |
| 7 | 2 | — | — | 4.5/2.0/0.8 | 700 | 36000 | 1040 | 10 | |
| 8 | 2 | 700 | 10 | 4.5/2.0 | — | — | 1040 | 60 | |
| 9 | 4 | — | — | 4.5/2.0 | 700 | 3600 | 1100 | 10 | |
| 10 | 5 | — | — | 4.5/2.0 | 700 | 3600 | 1080 | 10 | |

TABLE 2-continued

| Example No. | Steel No. | Heating of hot-rolled steel strips temp. (° C.) | Heating of hot-rolled steel strips seconds | cold-rolling (mm) | Heating of cold-rolled steel strips temp. (° C.) | Heating of cold-rolled steel strips seconds | Finish-annealing temp. (° C.) | Finish-annealing seconds | Note |
|---|---|---|---|---|---|---|---|---|---|
| 11 | 6 | — | — | 4.5/2.0 | 700 | 3600 | 1000 | 10 | |
| 12 | 7 | — | — | 4.5/2.0 | 700 | 3600 | 1040 | 10 | Comparative |
| 13 | 8 | — | — | 4.5/2.0 | 700 | 3600 | 1040 | 10 | Examples |
| 14 | 9 | — | — | 4.5/2.0 | 700 | 3600 | 1040 | 10 | |
| 15 | 2 | 1040 | 10 | 4.5/2.0 | — | — | 1040 | 10 | |
| 16 | 2 | 1040 | 10 | 4.5/2.0 | 700 | 3600 | 1040 | 10 | |
| 17 | 2 | — | — | 4.5/2.0 | 700 | 3600 | 850 | 10 | |
| 18 | 2 | — | — | 4.5/2.0 | 700 | 3600 | 1150 | 10 | |

A test piece cut off each annealed steel sheet was subjected to a tensile test at a room temperature.

Other test pieces cut off each steel sheet before and after finish-annealing were tested to detect a ratio of precipitates by weighing the residue after electrolytic dissolution of base elements other than precipitates.

Furthermore, test pieces for crystalline orientation were prepared by shaving steel sheets to ¾ of thickness and then polishing the steel sheets. Diffraction intensity of each test piece was measured at (211) and (200) planes by XRD, while diffraction intensity of a non-directional sample prepared from powdery material was measured at (211) and (200) planes in the same way. The measured values were substituted for formula (a) to calculate Integrated Intensity as an index of crystalline orientation.

Workability of each steel sheet was evaluated on the basis of an average plastic strain ratio $\bar{r}$ representing deep-drawability. The average plastic strain ratio was obtained by a tensile test as follows: Test pieces regulated as JIS #13B were prepared by cutting each steel strip along a rolling direction L, a traverse direction T rectangular to the direction L and a direction D crossing the direction L with 45 degrees. A uni-directional stretch pre-strain of 15% was applied to each test piece under the conditions regulated by JIS Z2254 (entitled "Test For Measuring Plastic Strain Ratio Of Thin Metal Sheet"), and plastic strain ratios $r_L$, $r_T$ and $r_D$ along the directions L, T and D, respectively, were calculated as ratios of thickness strains to horizontal strains. The calculation results $r_L$, $r_T$ and $r_D$ were substituted for the following formulas to obtain an average plastic strain ratio $\bar{r}$ and in-plane anisotropy $\Delta r$.

$$r\text{-}=(r_L+2r_D+r_T)/4$$

Toughness of each steel sheet was examined by V-notch Charpy impact test regulated by JIS Z2242 (entitled "Impact Test For Metal Materials") at a temperature in a range of −75° C. to 0° C. A ductility-embrittlement transition temperature of each steel sheet was obtained from the Charpy impact values.

Test results are shown in Table 3. It is noted that ferritic stainless steel Example Nos. 1–11 were superior of workability to Comparative Example No. 15 due to bigger plastic strain ratios $\bar{r}$, since ratios of precipitates before finish-annealing and crystalline orientation represented by Integrated Intensity were both kept in proper ranges. Each steel of Example Nos. 1–11 had a ductility-embrittlement transition temperature below −50° C., i.e., at the level that brittle fracture does not occur in practice. These results prove that precipitates advantageously control crystalline orientation of a finish-annealed steel sheet for improvement of workability.

Example Nos. 12–14 show results of stainless steels having compositions out of the range of the present invention. Example Nos. 15–18 show results of stainless steels which had compositions defined by the present invention but processed under different manufacturing conditions.

The steel of Example No. 16 had relatively good workability but inferior toughness due to excessive Nb content. The steels of Example Nos. 13 and 14 were good of toughness but inferior of workability, since Integrated Intensity was not kept in the specified range even by precipitation-treatment prior to finish-annealing due to the absence of Nb. The steel of Example No. 15, which was manufactured by a conventional process involving finish-annealing for re-crystallization without precipitation-treatment, was poor of workability. The steel of Example No. 16 was not improved in workability even by precipitation-treatment, since re-crystallized structure was generated during heating of a hot-rolled steel strip. A finish-annealed steel sheet each of Example Nos. 17 and 18 were poor of toughness, since precipitates were insufficiently dissolved in a steel matrix due to finish-annealing at a lower temperature in Example No. 17 or since crystal grains were coarsened due to finish-annealing at a higher temperature in Example No. 18.

TABLE 3

EFFECTS OF COMPOSITIONS AND MANUFACTURING CONDITIONS ON RATIOS OF PRECIPITATES AND PROPERTIES OF STEEL SHEETS

| Example No. | Steel No. | Ratios (%) of precipitates before finish-annealing | Ratios (%) of precipitates after finish-annealing | Integrated Intensity | a value $\bar{r}$ | toughness | Note |
|---|---|---|---|---|---|---|---|
| 1 | 1 | 1.1 | 0.2 | 1.2 | ○ | ○ | Inventive |
| 2 | 2 | 1.3 | 0.3 | 2.0 | ○ | ○ | Examples |

TABLE 3-continued

EFFECTS OF COMPOSITIONS AND MANUFACTURING CONDITIONS ON RATIOS OF PRECIPITATES AND PROPERTIES OF STEEL SHEETS

| Example No. | Steel No. | Ratios (%) of precipitates before finish-annealing | after finish-annealing | Integrated Intensity | a value $\bar{r}$ | toughness | Note |
|---|---|---|---|---|---|---|---|
| 3 | 3 | 1.1 | 0.3 | 1.2 | ○ | ○ | |
| 4 | 2 | 1.3 | 0.4 | 1.9 | ○ | ○ | |
| 5 | 2 | 1.3 | 0.4 | 1.8 | ○ | ○ | |
| 6 | 2 | 1.4 | 0.5 | 2.1 | ○ | ○ | |
| 7 | 2 | 1.6 | 0.6 | 1.7 | ○ | ○ | |
| 8 | 2 | 1.6 | 0.3 | 1.6 | ○ | ○ | |
| 9 | 4 | 1.2 | 0.5 | 1.5 | ○ | ○ | |
| 10 | 5 | 1.1 | 0.1 | 1.2 | ○ | ○ | |
| 11 | 6 | 2.0 | 0.2 | 2.3 | ○ | ○ | |
| 12 | 7 | 3.0 | 1.1 | 2.9 | X | X | Comparative |
| 13 | 8 | 0.1 | 0.1 | 1.0 | X | ○ | Examples |
| 14 | 9 | 0.1 | 0.1 | 0.9 | X | ○ | |
| 15 | 2 | 0.3 | 0.3 | 0.9 | X | ○ | |
| 16 | 2 | 1.2 | 0.3 | 0.9 | X | ○ | |
| 17 | 2 | 1.3 | 0.8 | 1.4 | ○ | X | |
| 18 | 2 | 1.2 | 0.3 | 0.9 | ○ | X | |

The underlined figures are out of the range of the present invention.
A value $\bar{r}$ not less than 1.5 is evaluated as ○ and less than 1.5 as X.
Toughness: a ductility-embrittlement transition temperature below −50° C. evaluated as ○, above −50° C. as X.

EXAMPLE 2

Several kinds of steels having compositions shown in Table 4 were melted in a 30 kg-vacuum furnace, cast to a slab of 40 mm in thickness, soaked 2 hrs. at 1250° C., hot-rolled to a thickness of 4.5 mm and then cooled with water. In Table 4, Nos. 1–9 are invented steels, No. 10 is a comparative steel, No. 11 corresponds to SUS409, and No. 12 corresponds to SUS436.

Each hot-rolled steel strip was cold-rolled to a thickness of 2.0 mm and then annealed under conditions shown in Table 5 (inventive examples) and Table 6 (comparative examples).

TABLE 4

COMPOSITIONS OF STAINLESS STEELS

| Steel No. | C | Si | Mn | Ni | Cr | Nb | N | Others | Note |
|---|---|---|---|---|---|---|---|---|---|
| | Alloying elements (mass %) | | | | | | | | |
| 1 | 0.007 | 0.85 | 0.81 | 0.07 | 8.63 | 0.35 | 0.006 | Cu: 0.06 | Inventive |
| 2 | 0.025 | 0.51 | 0.75 | 0.11 | 12.02 | 0.58 | 0.010 | — | Examples |
| 3 | 0.012 | 0.93 | 1.08 | 0.11 | 14.47 | 0.40 | 0.011 | Cu: 0.10 | |
| 4 | 0.014 | 0.31 | 0.34 | 0.12 | 17.85 | 0.42 | 0.010 | Mo: 0.52 | |
| 5 | 0.011 | 0.52 | 0.43 | 0.13 | 19.52 | 0.41 | 0.015 | Cu: 0.49 | |
| 6 | 0.009 | 0.30 | 0.21 | 0.09 | 16.72 | 0.39 | 0.008 | Cu: 1.59 | |
| 7 | 0.009 | 0.26 | 0.99 | 0.13 | 18.57 | 0.79 | 0.007 | Cu: 0.24, Mo: 2.94 | |
| 8 | 0.009 | 0.52 | 0.04 | 0.57 | 34.14 | 0.15 | 0.009 | Ti: 0.11, Al: 0.13 | |
| 9 | 0.004 | 0.12 | 0.18 | 0.09 | 20.11 | 0.20 | 0.016 | Ti: 0.07, Al: 5.52 | |
| 10 | 0.010 | 0.22 | 0.98 | 0.11 | 18.43 | 0.97 | 0.011 | Cu: 0.23, Mo: 2.24 | Comparative |
| 11 | 0.014 | 0.37 | 0.31 | 0.12 | 17.92 | — | 0.012 | Ti: 0.18, Mo: 1.03 | Examples |
| 12 | 0.007 | 0.53 | 0.44 | 0.08 | 11.15 | — | 0.005 | Ti: 0.21 | |

The underlined figures are out of the range of the present invention.

TABLE 5

MANUFACTURING CONDITIONS ACCORDING TO THE PRESENT INVENTION

| Example No | Steel No. | Heat-treatment: Hot-rolled steel strips temp.(° C.) | Seconds | Cold-rolling (mm) | Heat-treatment of Cold-rolled steel strips: Temp. (° C.) | seconds | Finish-Annealing temp. (° C.) | seconds |
|---|---|---|---|---|---|---|---|---|
| 1 | 1 | 700 | 10 | 4.5/2.0 | — | — | 900 | 10 |
| 2 | 2 | 700 | 10 | 4.5/2.0 | — | — | 1060 | 10 |
| 3 | 3 | 700 | 10 | 4.5/2.0 | 600 | 10 | 1040 | 10 |

TABLE 5-continued

| MANUFACTURING CONDITIONS ACCORDING TO THE PRESENT INVENTION | | | | | | | | |
|---|---|---|---|---|---|---|---|---|
| | | Heat-treatment | | | Heat-treatment of | | Finish-Annealing | |
| Example | Steel | Hot-rolled steel strips | | Cold-rolling | Cold-rolled steel strips | | temp. | |
| No | No. | temp.(° C.) | Seconds | (mm) | Temp. (° C.) | seconds | (° C.) | seconds |
| 4 | 3 | 600 | 60 | 3.5/1.5 | — | — | 1040 | 10 |
| 5 | 3 | — | — | 4.5/2.0 | 650 | 10 | 1040 | 10 |
| 6 | 3 | — | — | 4.5/2.0 | 500 | 36000 | 1040 | 10 |
| 7 | 3 | — | — | 4.5/2.0/0.8 | 600 | 10 | 1040 | 10 |
| 8 | 3 | — | — | 4.5/2.0 | — | — | 1040 | 10 |
| 9 | 3 | 700 | 10 | 4.5/2.0 | — | — | 1040 | 60 |
| 10 | 4 | — | — | 4.5/2.0 | 600 | 10 | 1000 | 10 |
| 11 | 5 | — | — | 4.5/2.0 | 600 | 10 | 1030 | 10 |
| 12 | 6 | — | — | 4.5/2.0 | 600 | 10 | 1020 | 10 |
| 13 | 7 | — | — | 4.5/2.0 | 600 | 10 | 1100 | 10 |
| 14 | 8 | — | — | 4.5/2.0 | 600 | 10 | 1080 | 10 |
| 15 | 9 | — | — | 4.5/2.0 | 600 | 10 | 1000 | 10 |

TABLE 6

| MANUFACTURING CONDITIONS FOR COMPARISON | | | | | | | | |
|---|---|---|---|---|---|---|---|---|
| | | Heat-treatment | | | Heat-treatment of | | Finish-Annealing | |
| Example | Steel | hot-rolled steel strips | | cold-rolling | cold-rolled steel strips | | temp. | |
| No | No. | temp.(° C.) | Seconds | (mm) | temp. (° C.) | seconds | (° C.) | seconds |
| 16 | 10 | — | — | 4.5/2.0 | 600 | 10 | 1040 | 10 |
| 17 | 11 | — | — | 4.5/2.0 | 600 | 10 | 1040 | 10 |
| 18 | 12 | — | — | 4.5/2.0 | 600 | 10 | 1040 | 10 |
| 19 | 3 | 1040 | 10 | 4.5/2.0 | — | — | 1040 | 10 |
| 20 | 3 | 1040 | 10 | 4.5/2.0 | 600 | 10 | 1040 | 10 |
| 21 | 3 | 900 | 10 | 4.5/2.0 | — | — | 1040 | 10 |
| 22 | 3 | 400 | 3600 | 4.5/2.0 | — | — | 1040 | 10 |
| 23 | 3 | — | — | 4.5/2.0 | 300 | 36000 | 1040 | 10 |
| 24 | 3 | — | — | 4.5/2.0 | 900 | 10 | 1040 | 10 |
| 25 | 3 | — | — | 4.5/2.0 | 600 | 10 | 850 | 10 |
| 26 | 3 | — | — | 4.5/2.0 | 600 | 10 | 1150 | 10 |
| 27 | 8 | — | — | 6.0/2.0 | 650 | 10 | 1100 | 600 |

The underlined figures are out of the range of the present invention.

A test piece cut off each annealed steel strip was subjected to a tensile test at room temperature.

Other test pieces cut off steel strips before and after the finish-annealing were tested to detect ratios of fine precipitates and crystalline orientation by the same way as Example 1, but the crystalline orientation was represented by Integrated Intensity defined by the formula (b).

Workability and toughness of each steel sheet were also evaluated by the same way as Example 1.

All the test results are shown in Table 7 (inventive examples) and Table 8 (comparative examples).

It is understood from comparison of Table 7 with Table 8 that steels of Example Nos. 1–15 according to the present invention were superior of workability $\bar{r}$ with less in-plane anisotropy ($\Delta r$) to a steel of Example No. 19 manufactured by a conventional process, since a ratio of precipitates in a steel matrix before finish-annealing and crystalline orientation of the steel sheet (represented by Integrated Intensity) were held in proper ranges. Each steel of Example Nos. 1–15 had a ductility-embrittlement transition temperature below −50° C., i.e., at the level that brittle fracture does not occur in practical. These results prove that fine precipitates apparently effect an improvement of workability.

Example Nos. 16–18 show results of the comparative stainless steels. Example Nos. 19–26 show results of stainless steels, which had compositions defined by the present invention but processed under different manufacturing conditions.

The steel of Example No. 16 had relatively good workability but inferior toughness due to excessive Nb content. Steels of Example Nos. 17 and 18 were good of toughness but inferior of workability, since Integrated Intensity was not kept in the specified range even by precipitation-treatment prior to finish-annealing due to the absence of Nb.

Steels of Example Nos. 19 and 20 were not improved in workability even by precipitation-treatment for generation of fine precipitates, since hot-rolled steel strips were already transformed to re-crystallized structure by heating at 1040° C. above a temperature range specified in the present invention. Steels of Example Nos. 21 and 24 were inferior of in-plane anisotropy with Integrated Intensity out of the range specified by the present invention, since they were heated in a hot-rolled or cold-rolled state at a higher temperature so as to excessively generate fine precipitates. Steels of Example Nos. 22 and 23 were inferior of workability with Integrated Intensity out of the range specified by the present invention, since they were heated in a hot-rolled or cold-rolled state at a lower temperature so as to insufficiently generate fine precipitates. Steels of Example Nos. 25–27 were also inferior of workability, since precipitates were not completely dissolved in a steel matrix of Example No. 25 due to finish-annealing at a lower temperature, and crystal grains were coarsened due to finish-annealing at a higher temperature in Example No. 26 or for a longer time in Example No. 27.

TABLE 7

PROPERTIES OF INVENTED STAINLESS STEEL

| Example No. | Steel No. | Ratios of precipitates (%) Before finish-annealing | After finish-annealing | Integrated Intensity | $\bar{r}$ | Δr | toughness |
|---|---|---|---|---|---|---|---|
| 1 | 1 | 0.9 | 0.2 | 3.0 | ○ | ○ | ○ |
| 2 | 2 | 0.8 | 0.3 | 2.7 | ○ | ○ | ○ |
| 3 | 3 | 0.9 | 0.3 | 2.5 | ○ | ○ | ○ |
| 4 | 3 | 1.0 | 0.3 | 2.4 | ○ | ○ | ○ |
| 5 | 3 | 0.9 | 0.3 | 2.6 | ○ | ○ | ○ |
| 6 | 3 | 1.1 | 0.3 | 2.6 | ○ | ○ | ○ |
| 7 | 3 | 1.0 | 0.3 | 3.6 | ○ | ○ | ○ |
| 8 | 3 | 0.7 | 0.4 | 2.1 | ○ | ○ | ○ |
| 9 | 3 | 0.9 | 0.3 | 2.3 | ○ | ○ | ○ |
| 10 | 4 | 1.0 | 0.3 | 2.2 | ○ | ○ | ○ |
| 11 | 5 | 0.9 | 0.3 | 2.4 | ○ | ○ | ○ |
| 12 | 6 | 0.9 | 0.3 | 2.1 | ○ | ○ | ○ |
| 13 | 7 | 1.2 | 0.5 | 2.0 | ○ | ○ | ○ |
| 14 | 8 | 0.4 | 0.1 | 2.0 | ○ | ○ | ○ |
| 15 | 9 | 0.6 | 0.2 | 2.0 | ○ | ○ | ○ |

$\bar{r}$: 1.2 or more evaluated as ○, and less than 1.2 as X
Δr: 0.5 or less evaluated as ○, and more than 0.5 as X
Toughness: a ductility-embrittlement transition temperature below −50° C. evaluated as ○, above −50° C. as X

TABLE 8

PROPERTIES OF COMPARATIVE STAINLESS STEEL

| Example No. | Steel No. | Ratios of precipitates (%) Before finish-annealing | After finish-annealing | Integrated Intensity | $\bar{r}$ | Δr | toughness |
|---|---|---|---|---|---|---|---|
| 16 | 10 | 2.2 | 1.1 | 1.8 | X | ○ | X |
| 17 | 11 | 0.1 | 0.1 | 1.4 | X | X | ○ |
| 18 | 12 | 0.1 | 0.1 | 1.6 | X | X | ○ |
| 19 | 3 | 0.3 | 0.3 | 1.0 | X | X | ○ |
| 20 | 3 | 0.9 | 0.3 | 1.3 | X | X | ○ |
| 21 | 3 | 1.8 | 0.4 | 1.0 | ○ | X | ○ |
| 22 | 3 | 0.3 | 0.2 | 1.9 | X | ○ | ○ |
| 23 | 3 | 0.2 | 0.2 | 1.8 | X | ○ | ○ |
| 24 | 3 | 1.4 | 0.4 | 1.0 | ○ | X | ○ |
| 25 | 3 | 1.0 | 0.8 | 2.1 | ○ | ○ | X |
| 26 | 3 | 0.9 | 0.3 | 1.7 | ○ | X | X |
| 27 | 8 | 0.8 | 0.3 | 1.9 | ○ | X | X |

$\bar{r}$: 1.2 or more evaluated as ○, and less than 1.2 as X
Δr: 0.5 or less evaluated as ○, and more than 0.5 as X
Toughness: a ductility-embrittlement transition temperature below −50° C. evaluated as ○, above −50° C. as X The present invention as above-mentioned uses the effect of precipitates, which have been generated in a stage prior to finish-annealing, on control of crystalline orientation during finish-annealing, and so enables the production of a ferritic stainless steel sheet of good workability. Furthermore, in-plane anisotropy is reduced by severely controlling a ratio of fine precipitates and crystalline orientation.

The good workability is ensured, even when the steel sheet is relatively thick of 1–2 mm, without degradation of intrinsic properties such as heat-resistance, corrosion-resistance and toughness. The newly proposed ferritic stainless steel sheet will be used in broad industrial fields such as a member of an exhaust system for an automobile, due to the excellent properties.

The invention claimed is:

1. A method of manufacturing a ferritic stainless steel sheet having good workability with less anisotropy, which comprises the steps of:

providing a ferritic stainless steel consisting essentially of 0.03 mass % or less of C, 0.03 mass % or less of N, 2.0 mass % or less of Si, 2.0 mass % or less of Mn, 0.07–0.6 mass % of Ni, 9–35 mass % of Cr, 0.15–0.80 mass % of Nb and the balance being Fe except inevitable impurities;

precipitation-heating said stainless steel at a temperature (T) in a range of 450–750° C. for a time period (t) not longer than 20 hours with the provision that a value λ defined by a formula of $\lambda=(T+273)\cdot(20+\log t)/1000$, whereby temperature is in degree centigrade and time is measured by hours, is controlled within a range of 13–19 so as to distribute Nb-containing precipitates of 0.5 μm or less in particle size at a ratio of 0.4 mass % or more; and finish-annealing said stainless steel at a temperature in a range of 900–1100° C. for a time period not longer than 1 minute.

2. The method of manufacturing according to claim 1, wherein the stainless steel further contains at least one of Ti up to about 0.5 mass Mo up to about 3.0 mass %, Cu up to about 2.0 mass % and Al up to about 6.0 mass %.

3. The method of manufacturing according to claim 1, wherein fine precipitates are distributed at a total ratio of 0.4–1.2 mass % in a steel matrix by the precipitation-heating.

* * * * *

UNITED STATES PATENT AND TRADEMARK OFFICE

CERTIFICATE OF CORRECTION

PATENT NO. : 7,094,295 B2
APPLICATION NO. : 10/695185
DATED : August 22, 2006
INVENTOR(S) : Oku et al.

It is certified that error appears in the above-identified patent and that said Letters Patent is hereby corrected as shown below:

Column 19, Line 6, Claim 2, "Ti up to about 0.5 mass Mo" should read -- Ti up to about 0.5 mass %, Mo --

Signed and Sealed this

Second Day of January, 2007

JON W. DUDAS
*Director of the United States Patent and Trademark Office*